US007273404B2

(12) United States Patent
Kowalski et al.

(10) Patent No.: US 7,273,404 B2
(45) Date of Patent: Sep. 25, 2007

(54) MAGNETIC CONSTRUCTION MODULES FOR CREATING THREE-DIMENSIONAL ASSEMBLIES

(75) Inventors: Charles J. Kowalski, Ridgewood, NJ (US); Jeffrey H. Rosen, Aventura, FL (US); Lawrence I. Rosen, Mendham, NJ (US)

(73) Assignee: MEGA Brands America, Inc., Livingston, NJ (US)

( * ) Notice: Subject to any disclaimer, the term of this patent is extended or adjusted under 35 U.S.C. 154(b) by 44 days.

(21) Appl. No.: 10/966,011

(22) Filed: Oct. 15, 2004

(65) Prior Publication Data

US 2005/0155308 A1 Jul. 21, 2005

Related U.S. Application Data

(60) Provisional application No. 60/536,866, filed on Jan. 16, 2004.

(51) Int. Cl.
*A63H 33/04* (2006.01)
*A63H 33/08* (2006.01)

(52) U.S. Cl. ..... 446/92; 446/85; 446/114

(58) Field of Classification Search ..... 446/92, 446/105, 108, 111–116, 122, 129, 137–139
See application file for complete search history.

(56) References Cited

U.S. PATENT DOCUMENTS 242,821 A * 6/1881 Farmer ..... 434/280
1,236,234 A 8/1917 Troje
1,535,035 A 4/1925 Philipp
2,448,692 A 9/1948 Teetor
2,570,625 A 10/1951 Zimmerman et al.
2,633,662 A * 4/1953 Nelson ..... 446/114
2,795,893 A 6/1957 Vayo
2,846,809 A 8/1958 Majewski
2,872,754 A 2/1959 Cronberger
2,939,243 A 6/1960 Duggar
2,970,388 A * 2/1961 Yonkers ..... 434/277
2,983,071 A 5/1961 Oliver
3,077,696 A 2/1963 Barnett et al.

(Continued)

FOREIGN PATENT DOCUMENTS

DE 31 52 024 A1 12/1981

(Continued)

OTHER PUBLICATIONS

International Search Report, Apr. 14, 2003.

(Continued)

*Primary Examiner*—Eugene Kim
*Assistant Examiner*—Alyssa M Hylinski
(74) *Attorney, Agent, or Firm*—Michael Bednarek; Paul, Hastings, Janofsky & Walker LLP

(57) ABSTRACT

Magnetic structural components utilized to permit construction of a wide variety of structural profiles and to thereby increase design and/or construction flexibility and choice. The structural components each include a number of magnets operatively associated with a periphery thereof to provide a number of points of magnetic connection. In addition, each structural component has at least one mechanical connector operatively associated therewith to provide at least one point of mechanical connection. The structural components can be magnetically and/or mechanically interconnected to form a variety of different two or three-dimensional structural profiles of varying complexities.

21 Claims, 4 Drawing Sheets

U.S. PATENT DOCUMENTS 3,095,668 A 7/1963 Dorsett
3,184,882 A 5/1965 Vega
3,196,579 A 7/1965 Lepper
3,254,440 A 6/1966 Duggar
3,458,949 A 8/1969 Young
3,594,924 A 7/1971 Baker
3,601,921 A 8/1971 Strohmaier
3,606,333 A * 9/1971 Green ..... 273/239
3,655,201 A 4/1972 Nichols
3,696,548 A 10/1972 Teller
3,698,124 A * 10/1972 Reitzel et al. ..... 446/114
3,706,158 A 12/1972 Jensen
3,906,658 A 9/1975 Gross
3,998,003 A 12/1976 Rosenbaum
3,998,004 A * 12/1976 Ehrlich ..... 446/92
4,020,566 A 5/1977 Dreiding
4,026,086 A 5/1977 Langley
4,118,888 A 10/1978 Ogawa
4,238,905 A 12/1980 MacGraw, II
4,258,479 A 3/1981 Roane
D264,694 S 6/1982 Takahashi
4,334,870 A 6/1982 Roane
4,334,871 A 6/1982 Roane
4,364,196 A 12/1982 Shacket
4,462,596 A 7/1984 Yamamoto
4,509,929 A 4/1985 Zawitz
4,513,970 A 4/1985 Opresco et al.
4,629,192 A 12/1986 Nichols
4,650,424 A 3/1987 Mitchell
4,722,712 A 2/1988 McKenna
4,741,534 A 5/1988 Rogahn
4,836,787 A 6/1989 Boo
4,886,273 A 12/1989 Unger
5,009,625 A * 4/1991 Longuet-Higgins ..... 446/92
5,021,021 A 6/1991 Ballard
5,127,652 A 7/1992 Unger
5,347,253 A 9/1994 Ogikubo
5,409,236 A 4/1995 Therrien
5,411,262 A 5/1995 Smith
5,458,522 A 10/1995 Brooks, III
5,487,691 A 1/1996 Chiu
5,520,396 A * 5/1996 Therrien ..... 273/288
5,545,070 A 8/1996 Liu
5,643,038 A 7/1997 Olsen et al.
5,651,715 A 7/1997 Shedelbower
5,743,786 A 4/1998 Lindsey
5,746,638 A * 5/1998 Shiraishi ..... 446/92
5,785,529 A 7/1998 Hearn et al.
5,826,872 A 10/1998 Hall
5,827,104 A * 10/1998 Zheng ..... 446/114
5,833,465 A 11/1998 Jarzewiak
5,833,512 A * 11/1998 Nicola ..... 446/114
5,848,926 A 12/1998 Jardetzky et al.
5,873,206 A 2/1999 Roberts
6,017,220 A 1/2000 Snelson
6,024,626 A * 2/2000 Mendelsohn ..... 446/92
6,090,431 A 7/2000 Franklin et al.
6,116,981 A 9/2000 Zheng
6,149,487 A * 11/2000 Peng ..... 446/114
6,158,740 A 12/2000 Hall
6,241,249 B1 6/2001 Wang
6,256,914 B1 7/2001 Yeh
6,277,428 B1 8/2001 Franklin et al.
6,280,282 B1 8/2001 Puchalski
6,386,540 B1 5/2002 Stevkovski
6,431,936 B1 8/2002 Kiribuchi
6,491,563 B1 12/2002 Bailey
6,566,992 B1 5/2003 Vicentelli
6,626,727 B2 9/2003 Balanchi
6,749,480 B1 6/2004 Hunts
6,846,216 B1 1/2005 Balanchi
6,963,261 B2 11/2005 Vicentelli
6,969,294 B2 * 11/2005 Vicentelli ..... 446/92
2002/0115373 A1 8/2002 Lazerman
2002/0135125 A1 9/2002 Wu
2002/0167127 A1 11/2002 Fang
2003/0036333 A1 * 2/2003 Oakley ..... 446/85
2004/0018473 A1 1/2004 Tusacciu
2004/0063380 A1 4/2004 Chi et al.

FOREIGN PATENT DOCUMENTS

DE 33 23 489 1/1984
DE 39 10 304 A1 3/1989
DE 102 07 244 C1 2/2002
DE 202 02 183 U1 2/2002
FR 2 153 792 9/1971
FR 2 301 279 2/1975
GB 2 123 306 A 2/1984
JP 2001-173889 6/2001
WO WO89/10604 11/1989
WO WO99/60583 11/1999
WO WO 02/055168 7/2002
WO WO 0255168 A1 * 7/2002
WO WO 02/076565 A1 10/2002

OTHER PUBLICATIONS

German Office Action, Jun. 22, 2002.
Magna-Tiles Instruction Booklet, date unknown.
Gorbert, Matthew G., Orth, Maggle, and Ishii, Hiroshi, *Triangles: Tangible Interface for Manipulation and Exploration of Digital Information Topography*, Proceedings CH1/98, Apr. 18-23, 1998, pp. 49-56, CHI 98.

* cited by examiner

MAGNETIC CONSTRUCTION MODULES FOR CREATING THREE-DIMENSIONAL ASSEMBLIES

CROSS-REFERENCE TO RELATED PRIORITY APPLICATION

This patent application claims priority of U.S. Provisional Application Ser. No. 60/536,866, filed Jan. 16, 2004, and entitled "Magnetic Construction Modules For Creating Three-Dimensional Assemblies", the disclosure of which is incorporated herein by reference in its entirety.

FIELD OF THE INVENTION

The present invention is directed generally to puzzles and toys. More particularly, the present invention is directed to structural components having magnetic surfaces and which can be magnetically and/or mechanically coupled to form three-dimensional assemblies.

BACKGROUND OF THE INVENTION

Individuals often find enjoyment in the challenge of building aesthetic structural designs and/or functional structural models. Frequently, the utility associated with constructing such structures is found in the creative and/or problem solving process required to achieve a desired structural objective. Currently, construction assemblies that exploit magnetic properties to interlink various structural components and thereby form different two and/or three dimensional structures are known and can provide an added dimension of sophistication to the construction process. For example, the magnetic construction toy disclosed in Balanchi U.S. Pat. No. 6,626,727, the modular assemblies disclosed in Vicentielli U.S. Pat. No. 6,566,992, and the magnetic puzzle/toy disclosed in Smith U.S. Pat. No. 5,411,262. In particular, German Patent No. DE 202 02 183 U1 to Kretzschmar describes flat triangles, squares and rectangles used in conjunction with ferromagnetic balls to create a limited range of geometric constructions. The flat shapes disclosed in the Kretzschmar German Patent consist of magnets inserted in the corners of a triangular or square piece, or six magnets in a rectangular plate which can be attached to steel balls to create a limited number of three-dimensional shapes.

A significant shortcoming associated with each of the above-noted magnetic construction assemblies involves the inherently restrictive and at times penalizing design alternatives provided thereby. It is often the case, as noted with particular respect to the German '183 Patent, that these traditional magnetic construction assemblies have only a limited number of component parts, which parts typically have constrained geometries to ensure effective and suitably stable or secure connections. Thus, despite efforts to date, a need remains for a magnetic construction assembly that provides greater construction flexibility and/or design choice.

This and other needs/objectives are addressed by the present invention. Additional advantageous features and functionalities of the present invention will be apparent from the disclosure which follows, particularly when reviewed in conjunction with the accompanying drawings.

SUMMARY OF THE INVENTION

According to the present invention, structural components may be utilized to permit construction of a wide variety of structural profiles thereby increasing construction flexibility and/or design choice. The structural components of the present invention each include a number of magnets operatively associated with a periphery thereof to provide a number of points of magnetic connection. In addition, each structural component has at least one mechanical connector operatively associated therewith to provide at least one point of mechanical connection.

The present invention advantageously allows for two or more complementary structural components to be operatively connected via magnetic or mechanical connections to form a variety of different two or three-dimensional structural profiles of varying complexities. The present invention is advantageously suitable to magnetically cooperate with one or more ferromagnetic structures to provide even greater design and construction flexibility.

BRIEF DESCRIPTION OF THE DRAWINGS

For a better understanding of the present invention, reference is made to the following detailed description of various exemplary embodiments considered in conjunction with the accompanying drawings, in which.

DISCLOSURE OF THE INVENTION

Figure 1A:
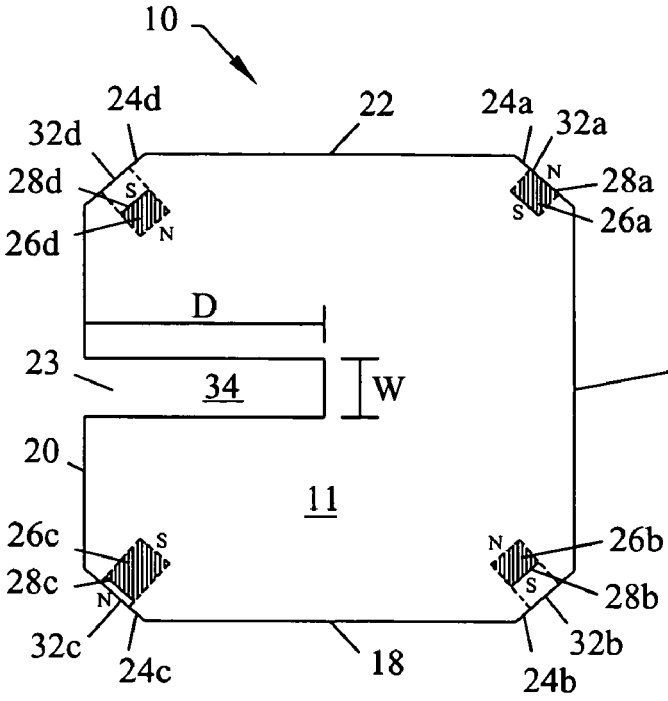
FIG. 1*a* is an elevational view of a structural component in accordance with one exemplary embodiment of the present invention.
Figure 1B:
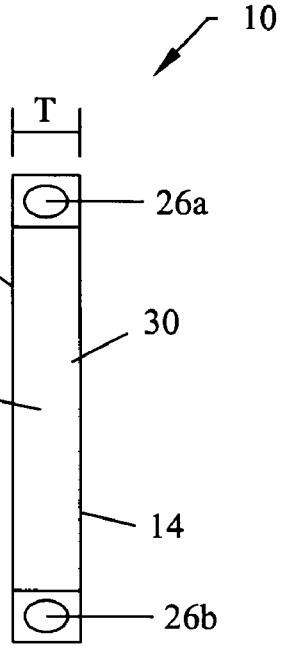
FIG. 1*b* is a top plan view of the structural component of FIG. 1*a;*

Referring to the drawings and, in particular, FIGS. 1*a* and *b*, a magnetic structural component in accordance with a preferred embodiment of the present invention is shown and generally represented by reference numeral 10. As shown, the structural component 10 has a substantially square body 11 with two faces 12, 14 operatively associated with four edges 16, 18, 20, 22 and four corners 24*a*, 24*b*, 24*c*, 24*d*. The body 11 preferably has a predefined thickness "T" and at least one of the four edges 16, 18, 20, 22 has at least one mechanical connecting element 23 operatively associated therewith.

The mechanical connecting element 23, in a preferred embodiment of the present invention, is a slot 34 located at the midpoint of the edge 20 with a predefined width "W". The predefined width "W" is preferably equal to or slightly greater than the thickness "T" of the structural component 10. The slot 34 preferably also has a predefined depth "D" extending in a direction at least substantially parallel to the edges 18, 22, preferably to half of the distance between the edge 20 and the edge 16.

The corners 24*a*, 24*b*, 24*c*, 24*d* are preferably biased at about 45 degrees and have at least one magnet 26*a*, 26*b*, 26*c*, 26*d*, respectively, operatively associated therewith. The magnets 26*a*, 26*b*, 26*c*, 26*d* are inserted permanently in each corner 24*a*, 24*b*, 24*c*, 24*d* of the structural component 10 with a surface 28*a*, 28*b*, 28*c*, 28*d* of each magnet exposed. The magnets 26*a*, 26*b*, 26*c*, 26*d* are preferably oriented so that the exposed surfaces 28*a*, 28*b*, 28*c*, 28*d* in adjacent corners (e.g., corners 24*a* and 24*b*) have opposite polarities to each other, indicated in FIG. 1*a* as N for north and S for south.

The structural component 10 may be fabricated from a solid plate 30 with pockets 32*a*, 32*b*, 32*c*, 32*d* in the respective corners 24*a*, 24*b*, 24*c*, 24*d*, formed by molding or drilling the pockets 32*a*, 32*b*, 32*c*, 32*d* into the solid plate 30, or by some other method known in the art. Each pocket 32*a*, 32*b*, 32*c*, 32*d* preferably has a size and shape so that the corresponding magnet 26*a*, 26*b*, 26*c*, 26*d* can be inserted permanently into the respective pocket 32*a*, 32*b*, 32*c*, 32*d*. Each magnet 26*a*, 26*b*, 26*c*, 26*d* and its corresponding pocket 32*a*, 32*b*, 32*c*, 32*d* may be cylindrical, rectangular or have some other shape, depending on the magnetic and/or mechanical connection type desired. As shown, the pockets 32*a*, 32*b*, 32*c*, 32*d* may be suitable to accommodate each magnet 26*a*, 26*b*, 26*c*, 26*d* so that the exposed surfaces 28*a*, 28*b*, 28*c*, 28*d* thereof are either flush or recessed with respect to the respective corners 24*a*, 24*b*, 24*c*, 24*d* in order to facilitate different connection characteristics. For instance, exposed surface 28*a*, as shown, is flush with respect to corner 24*a*, exposed surfaces 28*b* and 28*d*, as shown, are substantially recessed relative to the respective corners 24*b* and 24*d*, and exposed surface 28*c*, as shown, is only slightly recessed with respect to corner 24*c*.

By way of further illustration, the magnets 26*a*, 26*b*, 26*c*, 26*d* can be recessed in pockets 32*a*, 32*b*, 32*c*, 32*d* so that a beveled edge is formed enabling a connecting element (e.g., a ferromagnetic ball) to be both magnetically and mechanically connected to the module. Thus, by utilizing inherent magnetic and mechanical connecting properties, this magnetic/mechanical connection arrangement, as well as other similar arrangements, may advantageously provide for greater connection stability or performance (see, for example, applicants' copending U.S. Patent Application filed concurrently herewith and entitled "Magnetic Construction Module With Interchangeable Magnet Holders," the disclosure of which is incorporated herein by reference in its entirety.

Figure 2A:
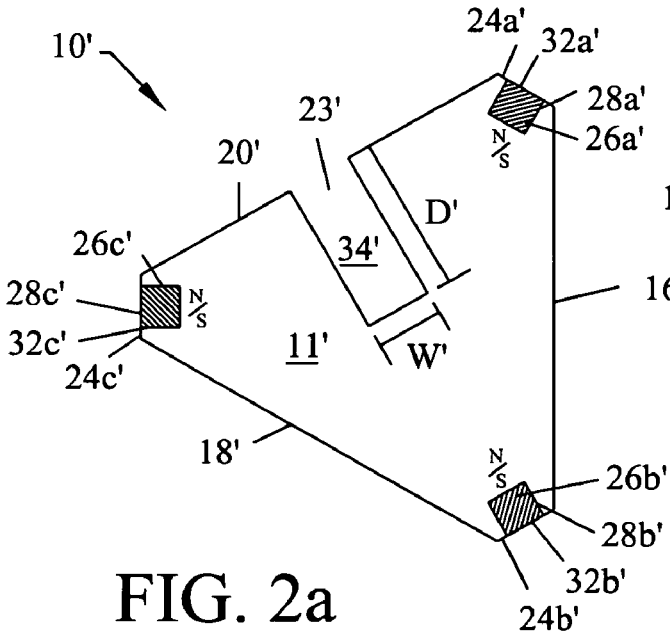
FIG. 2*a* is an elevational view of a structural component in accordance with another exemplary embodiment of the present invention.
Figure 2B:
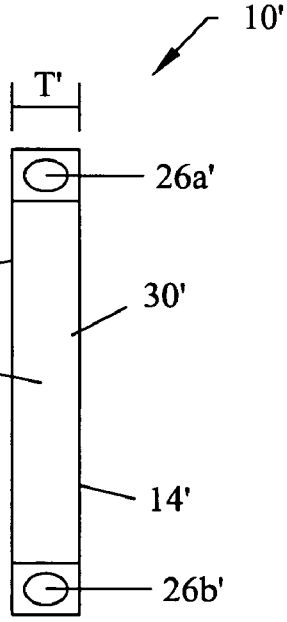
FIG. 2*b* is a top plan view of the structural component of FIG. 2*a;*

Referring to FIGS. 2*a* and 2*b*, a structural component 10', in another embodiment of the present invention, is shown with a substantially triangular body 11'. In FIGS. 2*a* and 2*b*, elements corresponding to those of structural component 10 are indicated by like reference numerals with a prime symbol associated therewith. The triangular body 11' has two faces 12', 14' operatively associated with three edges 16', 18', 20' and three corners 24*a*', 24*b*', 24*c*'. The body 11' preferably has a predefined thickness "T'" and at least one of the three edges 16', 18', 20' has at least one mechanical connecting element 23' operatively associated therewith.

The mechanical connecting element 23', in this embodiment of the present invention, is likewise a slot 34' located at the midpoint of the edge 20' so as to be diametrically opposite to the magnet 26*b*'. The slot 34' has a predefined width "W'" preferably equal to or slightly greater than the thickness "T'" of the structural component 10'. The slot 34' preferably also has a predefined depth "D'" extending in a direction at least substantially perpendicular to the edge 20', preferably to half of the distance between the edge 20' and the edge 16'.

The each corner 24*a*', 24*b*', 24*c*' is preferably biased at about 60 degrees and has at least one magnet 26*a*', 26*b*', 26*c*' operatively associated therewith. The magnets 26*a*', 26*b*', 26*c*' are preferably inserted permanently in each corner 24*a*', 24*b*', 24*c*' of the structural component 10' with a surface 28*a*', 28*b*', 28*c*' of each magnet exposed. The magnets 26*a*', 26*b*'26*c*' are preferably oriented so that the exposed surfaces 28*a*', 28*b*', 28*c*' in adjacent corners (e.g., corners 26*a*' and 26*b*') have opposite polarities to each other, indicated in FIG. 2*a* as N for north and S for south.

The structural component 10' can be fabricated from a solid plate 30' with pockets 32*a*', 32*b*', 32*c*' located in the respective corners 24*a*', 24*b*', 24*c*'. The pocket 32*a*'32*b*', 32*c*' can be formed by molding or drilling the pockets 32*a*', 32*b*', 32*c*' into the solid plate 30', or by some other method known in the art. Each pocket 32*a*', 32*b*', 32*c*' preferably has a size and shape so that the corresponding magnet 26*a*', 26*b*', 26*c*' can be inserted permanently into the respective pocket 32*a*', 32*b*', 32*c*'. Each magnet 26*a*', 26*b*', 26*c*' and its corresponding pocket 32*a*', 32*b*', 32*c*' may be cylindrical, rectangular, or have any other shape desired. Each of the pockets 32*a*', 32*b*', 32*c*', as shown, may be suitable to accommodate a magnet 26*a*', 26*b*', 26*c*' so that the exposed surfaces 28*a*', 28*b*', 28*c*' thereof may be either flush or recessed with respect to the respective corners 24*a*', 24*b*', 24*c*' so as to effectuate an improved connection via both mechanical and magnetic connection properties.

Figure 3A:
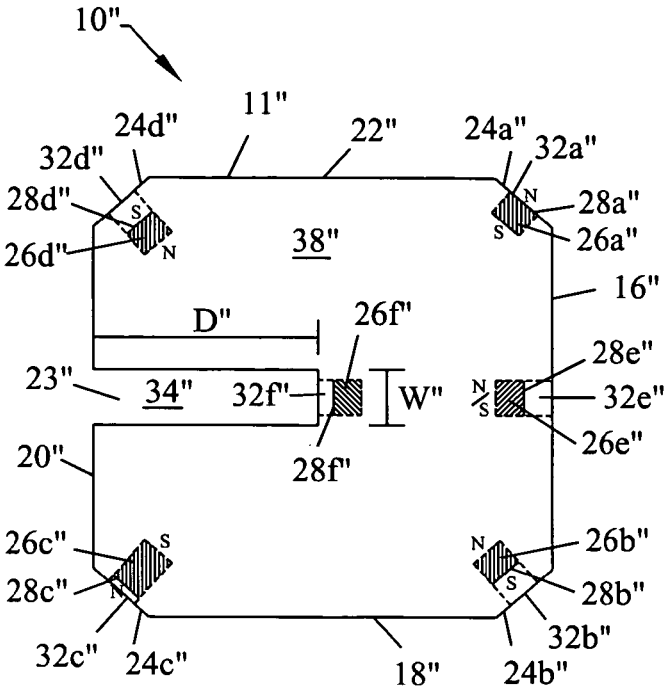
FIG. 3*a* is an elevational view of a structural component in accordance with still another exemplary embodiment of the present invention.
Figure 3C:
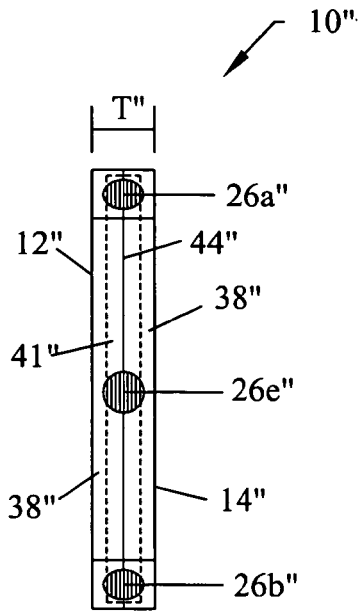
FIG. 3*c* is a top plan view of the structural component of FIG. 3*a;*
Figure 3B:
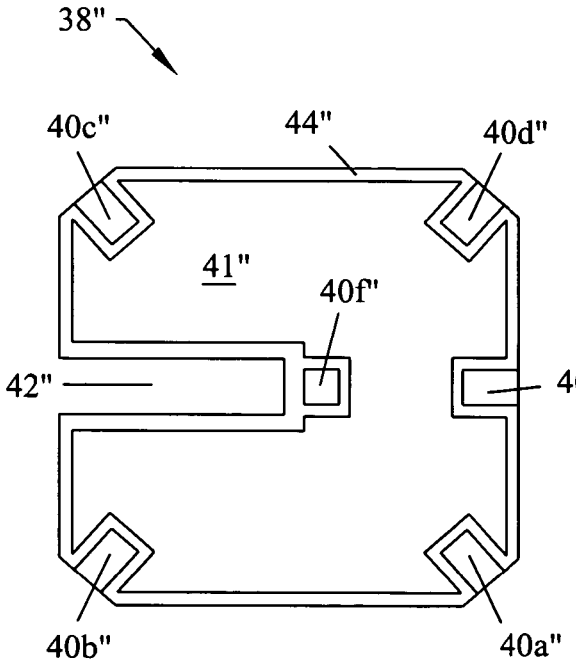
FIG. 3*b* is a cross-sectional elevational view similar to FIG. 3*a* showing a structural component constructed in accordance with another exemplary embodiment of the present invention.

Referring to FIGS. 3*a* through 3*c*, a structural component 10", in another embodiment of the present invention, is shown with a body 11" substantially similar to that of body 11. In FIGS. 3*a* through 3*c* elements corresponding to those of structural component 10 are indicated by like reference numerals with a double prime symbol associated therewith. In this embodiment of the present invention, two identically shaped members, such as member 38" of FIG. 3*b*, are preferably joined to form a hollow structural component 10" having a similar arrangement of elements to the structural component 10. Each member 38" preferably has half-pockets 40*a*", 40*b*", 40*c*", 40*d*", 40*e*", 40*f*", a slot 42" and a raised edge 44" integrally formed therein. The raised edge 44" generally runs along the perimeters of the member 38" and the slot 42", except where it defines the half-pockets 40*a*", 40*b*", 40*c*", 40*d*", 40*e*", 40*f*". The two members 38" may be joined by glue or by welding along their respective raised edges 44", forming the hollow structural component 10" having a central compartment 41". The half-pockets 40*a*", 40*b*", 40*c*", 40*d*", 40*e*", 40*f*" on one member 38" are aligned with and joined to the corresponding and complementary half pockets of a mirror image member to form pockets 32*a*", 32*b*", 32*c*", 32*d*", 32*e*", 32*f*" for insertion of the respective magnets 26*a*", 26*b*", 26*c*", 26*d*", 26*e*", 26*f*". An object, such as a label or decoration, may be placed within the compartment 41" of the hollow structural component 10" to enhance its appearance. The two at least substantially identical members 38" may be formed in different colors or of different materials.

In other embodiments of the present invention, additional magnets may be operatively associated with the structural component 10, 10', 10". For instance, as shown in FIGS. 3*a* and 3*b*, a magnet 26*e*" can be inserted permanently at the midpoint of an edge (e.g., edge 16", edge 18", and edge 22") so that one surface 28*e*" thereof is exposed. The exposed surface 28*e*" may have either polarity N or polarity S. Further, a magnet (not shown) can be operatively associated with mechanical connecting element 23" (e.g., slot 34").

Figure 4:
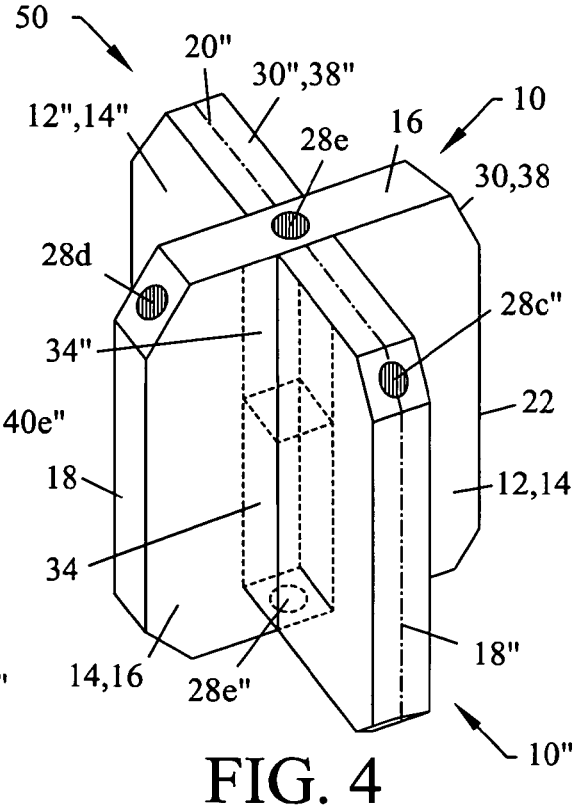
FIG. 4 is a perspective view of two interconnected structural components in accordance with an illustrative embodiment of the present invention.

Having identified and described various embodiments of the present invention, in use, two or more structural components 10, 10', 10" can be magnetically and/or mechanically interconnected to form any of a variety of construction profiles. For example, as shown in FIG. 4, two structural components (e.g., component 10 and component 10") may be mechanically connected by interlocking their respective slots 34, 34" to form a three-dimensional cruciform assembly 50. In FIG. 4, corresponding elements of each structural component 10, 10" have the same reference numerals, with the elements of structural component 10" being differentiated from those of structural component 10 by use of a double prime symbol. With the foregoing explanatory comments in mind, each of the slots 34, 34" of the structural components 10, 10" slides completely over the faces 12, 14, 12", 14" of the other structural component 10, 10" to create a cruciform assembly 50, in which the faces 12, 14" of the two structural components 10, 10" are oriented at least substantially 90 degrees to each other. The edge 16 of the structural component 10 preferably is flush with the edge 20". Similarly, the edge 16" of the structural component 10" preferably is flush with the edge 20 of the structural component 10. The magnetic surfaces 28*e*, 28*e*" of the respective structural components 10, 10" are diametrically opposed to each other on the cruciform assembly 50.

Referring to FIGS. 5-8, a wide variety of assembled structures, ranging from the simple to the extremely complex, can be created by the imaginative user by combining cruciform assemblies 50, structural components 10, 10', 10" and/or ferromagnetic balls 46. The structural components 10, 10', 10" can also be combined with the wheel-like components disclosed in applicants' copending U.S. Patent Application filed concurrently herewith and entitled "Magnetic Construction Kit With Wheel-Like Components," the disclosure of which is incorporated herein by reference in its entirety.

Figure 5:
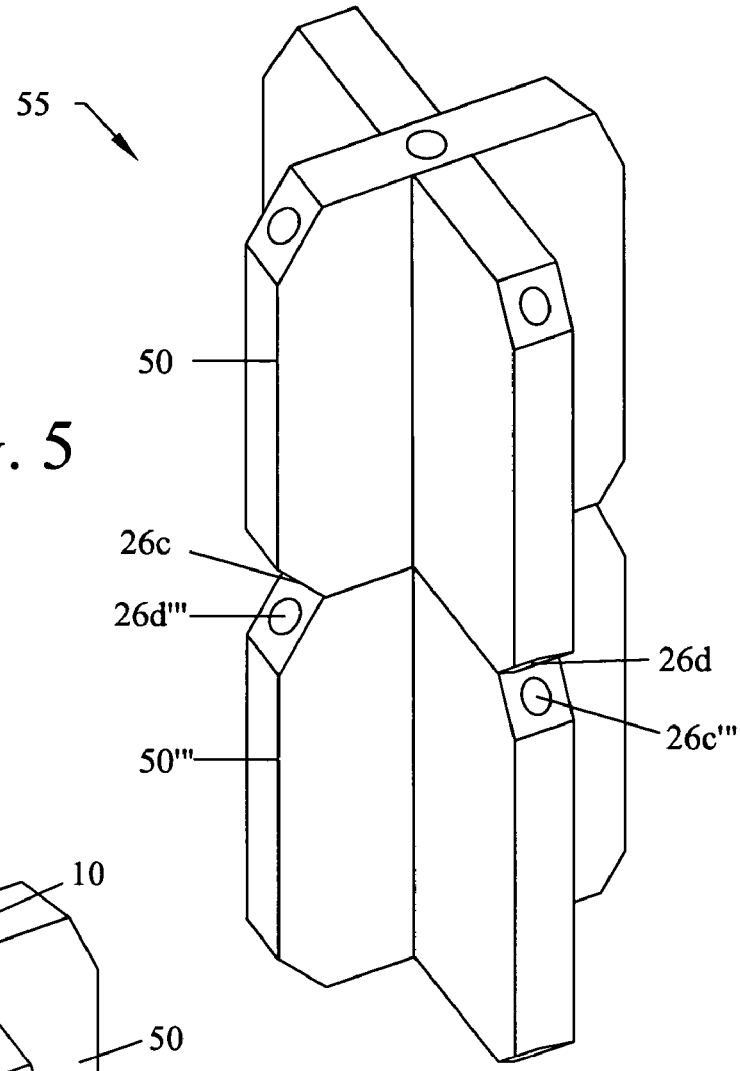
FIG. 5 is a perspective view of an exemplary construction profile in accordance with an illustrative embodiment of the present invention.

Referring to FIG. 5, an illustrative construction profile 55 may be formed by joining two cruciform assemblies 50, 50'" as shown. The cruciform assemblies 50, 50'", may preferably be joined at the magnetic surface 28*e* of the cruciform assembly 50 and the magnetic surface 28*e*'" of the cruciform assembly 50'", both magnetic surfaces 28, 28*e*'" being hidden in FIG. 5 by the cruciform assemblies 50, 50'". The orientation of the cruciform assemblies 50, 50'" with respect to each other is maintained by the magnetic attraction of their respective corner magnets where the two cruciform assemblies 50, 50'" adjoin each other (e.g., magnet 26*c* of assembly 50 and magnet 26*d*'" of assembly 50'" are attracted to each other and magnet 26*d* of assembly 50 and assembly 26*c*'" of assembly 50'" are attracted to each other).

Figure 6:
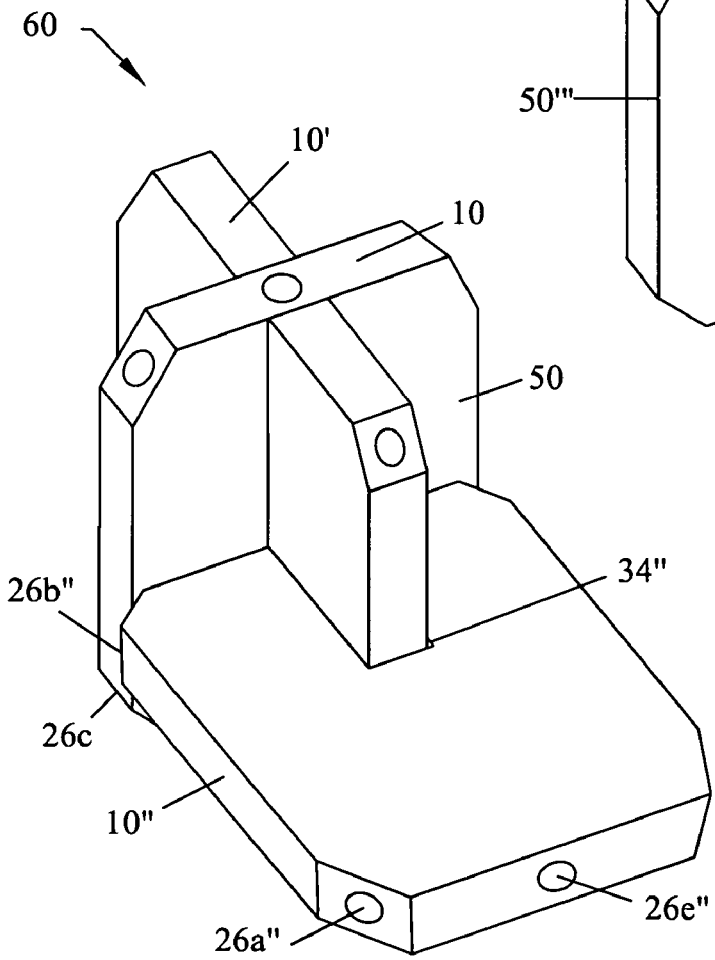
FIG. 6 is a perspective view of an exemplary construction profile in accordance with another illustrative embodiment of the present invention.

Referring to FIG. 6, another illustrative construction profile 60 may be formed by joining the structural component 10", for instance, to the cruciform assembly 50. The slot 34" of the structural component 10" preferably engages the cruciform assembly 50 as shown and the structural component 10" may preferably be held in place via a magnetic attraction, such as, for example, between the corner magnet 26*b*" of structural component 10" and the corner magnet 26*c* of cruciform assembly 50 and between the corner magnet 26*c*" of structural component 10" and the corner magnet 26*b* of cruciform assembly 50, both magnet 26*c*" and magnet 26*b* being hidden in FIG. 6.

Figure 7:
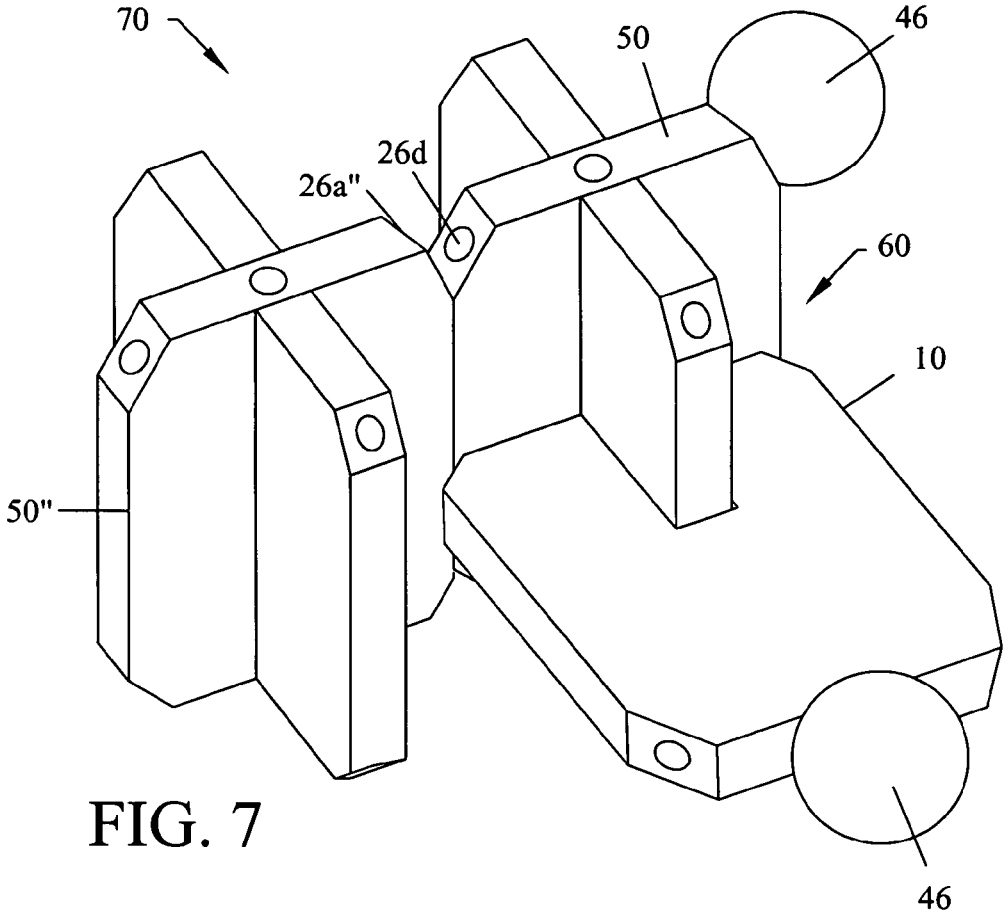
FIG. 7 is a perspective view of an exemplary construction profile in accordance with still another illustrative embodiment of the present invention.

Referring to FIG. 7, a further illustrative construction profile 70 may be formed by attaching two cruciform assemblies 50, 50", for instance, via magnetic attraction between the corner magnet 26*d* of assembly 50 and the corner magnet 26*a*" of assembly 50" and between the corner magnet 26*c* of assembly 50 and the corner magnet 26*b*" of assembly 50" (corner magnets 26*c* and 26*b*" are hidden in FIG. 7). The ferromagnetic balls 46, as shown, may be joined to corner magnet 26*a* of cruciform assembly 50 and/or, for example, to the end magnet 26*e*" of the structural component 10" as desired. Also, both magnet 26*a* and magnet 26*e*" being hidden in FIG. 7, can be used as connectors to other structural components or cruciform assemblies as desired. For example, as shown, a structural component 10 may be mechanically connected to the crucifix assembly 50 via slot 34.

Figure 8:
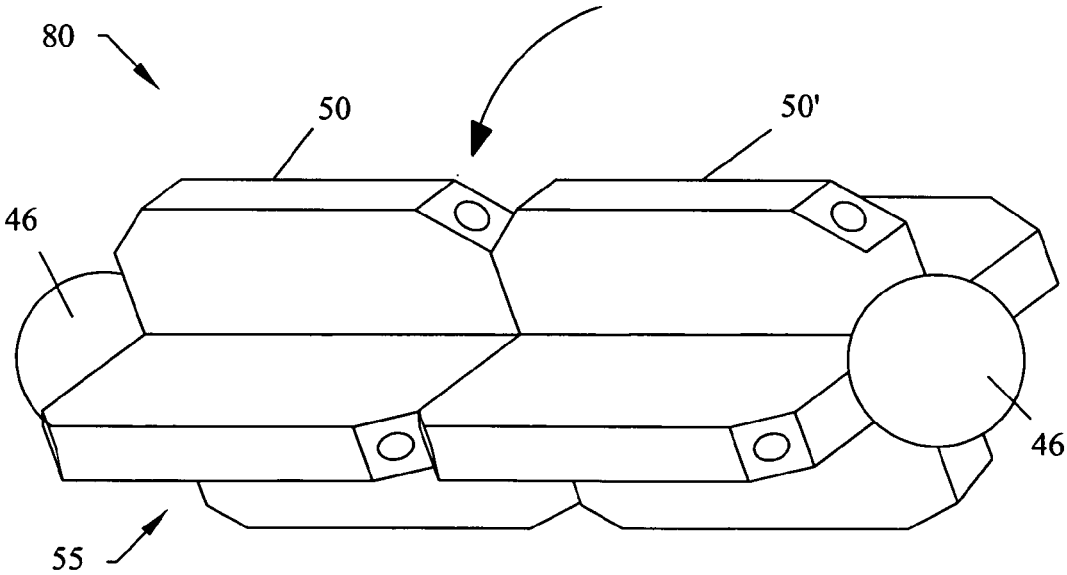
FIG. 8 is a perspective view of an exemplary construction profile in accordance with a further illustrative embodiment of the present invention.

Referring to FIG. 8, an illustrative rotatable construction profile 80 can be created, for example, by magnetically connecting ferromagnetic balls 46 to magnets 26*e*, 26*e*'" operatively associated at opposite ends of the construction profile 55 of FIG. 5 (i.e., magnets 26*e*, 26*e*'" being hidden in FIG. 8). The construction profile 80 can be made to rotate freely while the ferromagnetic balls 46 are held stationary. For example, magnetic attraction/repulsion from nearby magnets can be used in conjunction with the rotating construction profile 80 to create a motor.

Although the invention disclosed herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the invention. For example, the planar structural components may be made in other rectangular shapes than a square, or in shapes having a number of corners other than four, such as triangular or hexagonal shapes. The slots may be formed so as to open at a corner of a planar structural component and extend inward at an angle to one or more edges of the structural component. The shape of the slot itself may be formed so that the planar surfaces of two interlocked structural components are oriented at some angle other than 90 degrees. In addition, the faces, edges and/or corners may be provided with any of a variety of textures and/or surface structures in order to effectuate construction of secure, stable structural profiles.

What is claimed is:

1. A magnetic structural component comprising:

a flat polygonal body having a first planar face, the first planar face having a center, a second planar face opposite to the first planar face, at least one edge between the first planar face and the second planar face, the at least one edge defining a thickness of the body, at least one biased corner when the body is viewed in a direction facing the first planar face, and a slot from the at least one edge toward the center of the body when the body is viewed in the direction facing the first planar face, the slot comprising a first side wall, a second side wall opposite to the first side wall, and a third side wall between and transverse to the first side wall and the second side wall, a slot magnet disposed in the body, the slot magnet having a slot magnet axis running from its north to south poles and a magnetic planar face that is perpendicular to the slot magnet axis, the slot magnet axis aligned perpendicularly with the third side wall and parallel to the first sidewall and the second side wall when viewed in the direction facing the first planar face, and the magnetic planar face of the slot magnet disposed adjacent to and parallel with the third side wall, wherein each of the at least one biased corner has a magnet operatively associated therewith, wherein the magnet has an axis from its north to south poles, and wherein the axis is parallel to the first and second planar faces and intersects the center of the body.

2. The magnetic structural component of claim 1, wherein said slot is dimensioned to operatively accommodate a second slot of a complementary structural component, the complementary structural component comprising a second flat polygonal body defining the second slot comprising a first opposing side wall, a second opposing side wall opposite to the first opposing side wall, and a transverse side wall between and transverse to the first opposing side wall and the second opposing side wall, and a second slot magnet disposed in the second body, the second slot magnet having a second slot magnet axis running from its north to south poles and a magnetic planar face that is perpendicular to the second slot magnet axis, the second slot magnet axis aligned perpendicularly with the transverse side wall and parallel to the first opposing sidewall and the second opposing side wall when viewed in the direction facing the first planar face, and the magnetic planar face of the second slot magnet disposed adjacent to and parallel with the transverse side wall, wherein the first slot magnet engages the second slot magnet when the slot engages the second slot and the third side wall of the magnetic structural component mates with the transverse wall of the complementary structural component.

3. The magnetic structural component of claim 1, wherein each magnet is fixedly disposed in a pocket suitable to permanently retain such magnet.

4. The magnetic structural component of claim 1, wherein said body is a solid structure.

5. The magnetic structural component of claim 1, wherein said body is a composite hollow structure comprising:

a first planar member corresponding to the shape of the first planar face, the first planar member having a first raised edge extending along a perimeter edge of the first planar member and defining a first half-pocket for each magnet of the at least one biased corner and for the slot magnet; and a second planar member corresponding to the shape of the second planar face, the second planar member having a second raised edge extending along a perimeter edge of the second planar member and defining a second half-pocket for each magnet of the at least one biased corner and for the slot magnet, wherein the first raised edge and the second raised edge are joined to form the at least one edge of the body and a full pocket for each magnet of the at least one biased corner and for the slot magnet.

6. The magnetic structural component of claim 1, further comprising a magnet operatively associated with the at least one of said edges.

7. A three-dimensional magnetic construction assembly formed from two-dimensional plates, the assembly comprising:

a plurality of plates, each plate comprising a flat polygonal body defined by a first planar face, a second planar face opposing the first planar face, and a perimeter face between and transverse to the first planar face and the second planar face, wherein the first planar face and the second planar face define a slot when viewed from a direction facing the first planar face, wherein the slot comprises a first opposing side wall, a second opposing side wall opposite to and parallel with the first opposing side wall, and a transverse side wall in between and transverse to the first opposing side wall and the second opposing side wall, and wherein the body has a plurality of biased corners when viewed from the direction facing the first planar face, a plurality of corner magnets disposed in the body, each corner magnet disposed adjacent to the each biased corner, a slot magnet disposed in the body, the slot magnet having a slot magnet axis running from its north to south poles and a magnetic planar face that is perpendicular to the slot magnet axis, the slot magnet axis aligned perpendicularly with the transverse side wall of the slot and parallel to the first opposing sidewall and the second opposing side wall when viewed in the direction facing the first planar face, and the magnetic planar face of the slot magnet disposed adjacent to and parallel with the transverse side wall; and a plurality of ferromagnetic balls, wherein a first plate couples with a second plate such that a first slot of the first plate engages a second slot of the second plate and a first slot magnet of the first plate faces and couples with a second slot magnet of the second plate, wherein the first planar face of the first plate is perpendicular to the first planar face of the second plate, and wherein a ferromagnetic ball is magnetically held to a biased corner of the first plate by a corner magnet of the biased corner.

8. The assembly of claim 7, wherein the first plate and the second plate are identically sized and shaped, and have a square shape with four biased corners when viewed in the direction facing the first planar face, such that, when coupled together, the first plate and the second plate form a first three-dimensional cruciform assembly with eight outwardly facing corner magnets, wherein the assembly further comprises ferromagnetic balls magnetically coupled to each of the corner magnets.

9. The assembly of claim 8, wherein the axes of the four corner magnets of the first plate and the axes of the four corner magnets of the second plate run between the first slot magnet and the second slot magnet.

10. The assembly of claim 8, wherein the first plate, the second plate, a third plate, and a fourth plate are identically sized and shaped, wherein the third plate and the fourth plate are coupled together to form a second three-dimensional cruciform assembly with eight outwardly facing corner magnets, and wherein the first three-dimensional cruciform assembly and the second three-dimensional cruciform assembly are coupled together by two ferromagnetic balls.

11. The assembly of claim 7, wherein the first plate and the second plate are identically sized and shaped, and have a square shape with four biased corners when viewed in the direction facing the first planar face, such that, when coupled together, the first plate and the second plate form a first three-dimensional cruciform assembly with eight outwardly facing corner magnets, wherein each plate further comprises an axial magnet disposed in the body adjacent to a perimeter face opposite to a perimeter face in which the slot is defined, wherein the axial magnet has an axial magnet axis running from its north to south poles and an axial magnetic planar face that is perpendicular to the slot magnet axis, wherein the axial magnet axis coincides with the slot magnet axis, and wherein the axial magnetic planar face is disposed adjacent to and parallel with the perimeter face opposite to the perimeter face in which the slot is defined, and wherein the slot magnet axis and the axial magnet axis of the first plate coincide with the slot magnet axis and the axial magnet axis of the second plate when coupled to form a first cruciform assembly.

12. The assembly of claim 11, wherein a first ferromagnetic ball is magnetically coupled with the axial magnet of the first plate and a second ferromagnetic ball is coupled with the axial magnet of the second plate, such that the first cruciform assembly rotates about an axis coincidental with the slot magnet axis and the axial magnet axis of the first plate and the slot magnet axis and the axial magnet axis of the second plate.

13. The assembly of claim 11, wherein a second cruciform assembly identical to the first cruciform assembly is coupled to the first cruciform assembly by an inside axial magnet on each assembly, wherein the axis of the inside axial magnet of the first cruciform assembly coincides with the axis of the inside axial magnet of the second cruciform assembly.

14. The assembly of claim 13, wherein a first ferromagnetic ball is magnetically coupled with an outside axial magnet of the first cruciform assembly and a second ferromagnetic ball is coupled with an outside axial magnet of the second cruciform assembly, such that the first and second cruciform assemblies rotate about an axis coincidental with the axes of the axial magnets and the slot magnets of the first and second cruciform assemblies.

15. The assembly of claim 13, wherein polarities of the corner magnets of the first cruciform assembly are opposite to the polarities of adjacent corner magnets of the second cruciform assembly such that the first cruciform assembly and the second cruciform assembly are maintained in alignment.

16. The assembly of claim 7, wherein the first slot magnet axis and the second slot magnet axis are coincidental.

17. The assembly of claim 7, wherein the flat polygonal body of one plate of the plurality of plates comprises a triangle with three biased corners connected by three edges when viewed in the direction facing the first planar surface, and wherein the slot extends from one edge of the three edges toward the center of the triangle.

18. The assembly of claim 17, wherein the three biased corners are biased approximately 60 degrees.

19. The assembly of claim 7, wherein the flat polygonal body of one plate of the plurality of plates comprises a triangle with three biased corners when viewed in the direction facing the first planar surface, wherein a corner magnet disposed in one of the three biased corners has a corner magnet axis running from its north to south poles, and wherein the slot magnet axis coincides with the corner magnet axis when viewed in the direction facing the first planar surface.

20. A three-dimensional magnetic construction assembly formed from two-dimensional plates, comprising:

a first plate and a second plate, each of the first plate and the second plate having a first planar face, a second planar face opposing the first planar face, and a perimeter face between and transverse to the first planar face and the second planar face, wherein the first planar face and the second planar face are shaped as a quadrilateral having four sides at right angles to each other, wherein the first planar face and the second planar face define a slot extending from a midpoint of one of the four sides toward the center of the each plate, when viewed from a direction facing the first planar face, and wherein the slot comprises a first opposing side wall, a second opposing side wall opposite to and parallel with the first opposing side wall, and a transverse side wall in between and transverse to the first opposing side wall and the second opposing side wall, a perimeter magnet disposed in the each plate adjacent to the perimeter face at a side of the each plate opposite to the side in which the slot is defined, wherein the perimeter magnet has a perimeter magnet axis running from its north to south poles and a perimeter magnetic planar face that is perpendicular to the perimeter magnet axis and parallel to the perimeter face, wherein the perimeter magnet axis is parallel to the first opposing sidewall and the second opposing side wall when viewed in the direction facing the first planar face, wherein the slot of the first plate and the slot of the second plate engage each other such that the first planar face of the first plate is perpendicular to the first planar face of the second plate and the perimeter magnet axis of the first plate coincides with the perimeter magnet axis of the second plate;

a first ferromagnetic ball magnetically coupled to the perimeter magnet of the first plate; and a second ferromagnetic ball magnetically coupled to the perimeter magnet of the second plate, wherein the engaged first plate and second plate rotate about the coincidental perimeter magnet axes and with respect to the first ferromagnetic ball and the second ferromagnetic ball.

21. The assembly of claim 20, wherein the first planar face and the second planar face have four biased corners, and wherein each of the first plate and the second plate further comprises:

a corner magnet disposed in each of the four corners; and a slot magnet disposed in the each plate, the slot magnet having a slot magnet axis running from its north to south poles and a magnetic planar face that is perpendicular to the slot magnet axis, the slot magnet axis aligned perpendicularly with the transverse side wall of the slot and parallel to the first opposing sidewall and the second opposing side wall when viewed in the direction facing the first planar face, and the magnetic planar face of the slot magnet disposed adjacent to and parallel with the transverse side wall, wherein the slot magnet of the first plate faces and couples with the slot magnet of the second plate.

* * * * *